US008506113B2

(12) United States Patent
Sanchez et al.

(10) Patent No.: US 8,506,113 B2
(45) Date of Patent: Aug. 13, 2013

(54) HIGH POWERED LIGHT EMITTING DEVICE

(76) Inventors: Fernando Roberto Sanchez, Buenos Aires (AR); Gilmar Aparecido de Souza, Sao Paulo (BR)

( * ) Notice: Subject to any disclaimer, the term of this patent is extended or adjusted under 35 U.S.C. 154(b) by 455 days.

(21) Appl. No.: 12/848,420

(22) Filed: Aug. 2, 2010

(65) Prior Publication Data

US 2012/0026729 A1 Feb. 2, 2012

(51) Int. Cl.
*F21V 7/20* (2006.01)
*F21V 29/00* (2006.01)

(52) U.S. Cl.
USPC ..... 362/218; 362/217.02

(58) Field of Classification Search
USPC ..... 362/218, 217.12, 217.02, 335
See application file for complete search history.

(56) References Cited

U.S. PATENT DOCUMENTS

| | | | |
|---|---|---|---|
| 6,583,550 | B2 | 6/2003 | Iwasa et al. |
| 7,114,830 | B2 | 10/2006 | Robertson et al. |
| 2009/0261706 | A1 | 10/2009 | Sorella et al. |

*Primary Examiner* — Joseph L Williams
(74) *Attorney, Agent, or Firm* — Schmeiser, Olsen & Watts, LLP

(57) ABSTRACT

The present invention discloses an electronic lighting device. The device comprises a plurality of light-emitting diodes mounted on a thermal dissipation base and protected by a translucent cover; said device is specially designed to replace fluorescent tubes, i.e., in relation to its general construction; the electronic lighting device of the present invention has an external shape similar to the standard shapes of conventional fluorescent tubes, and an internal electronic circuit responsible for converting the electrical signal from any reactor into an electrical signal applied to light-emitting diodes. The present invention is free from a printed circuit board, and does not require the use of heat dissipation paste.

34 Claims, 6 Drawing Sheets

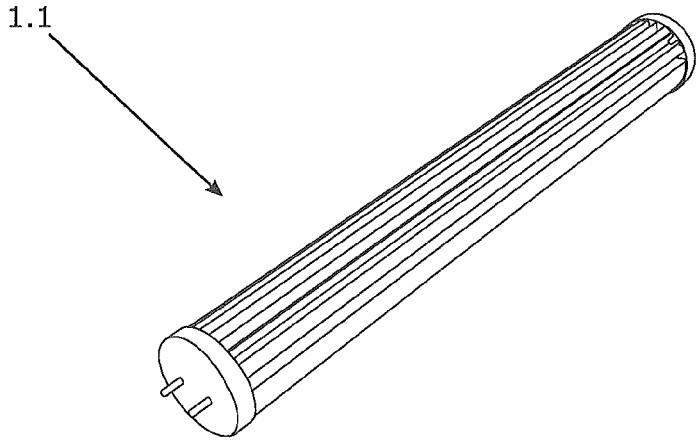
FIGURE 1.1
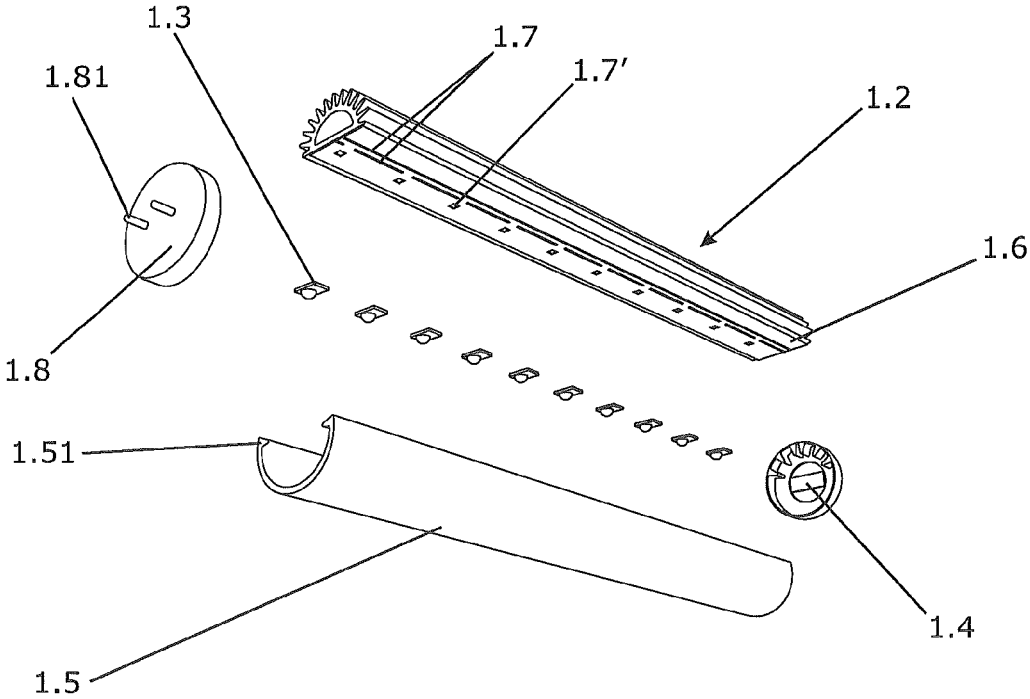
FIGURE 1.2

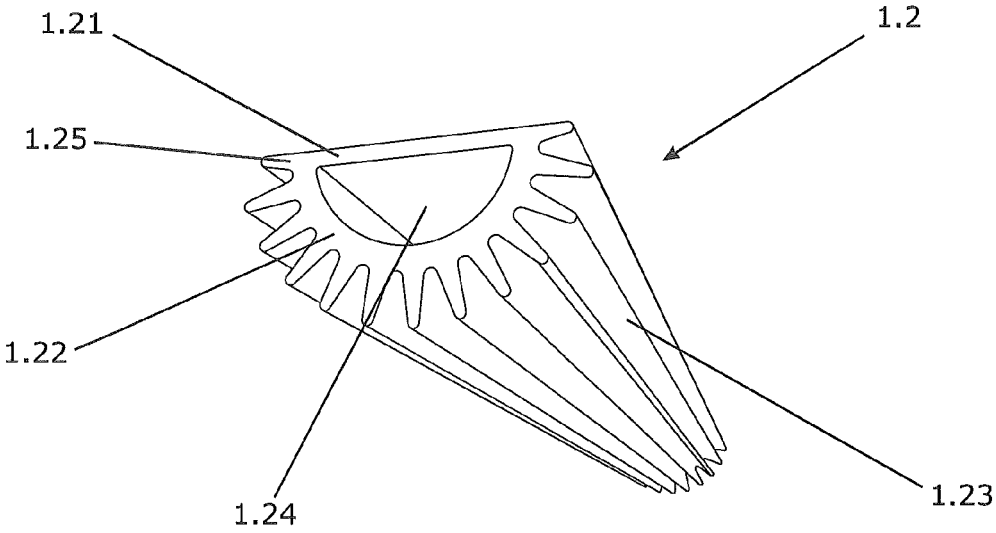
FIGURE 1.3
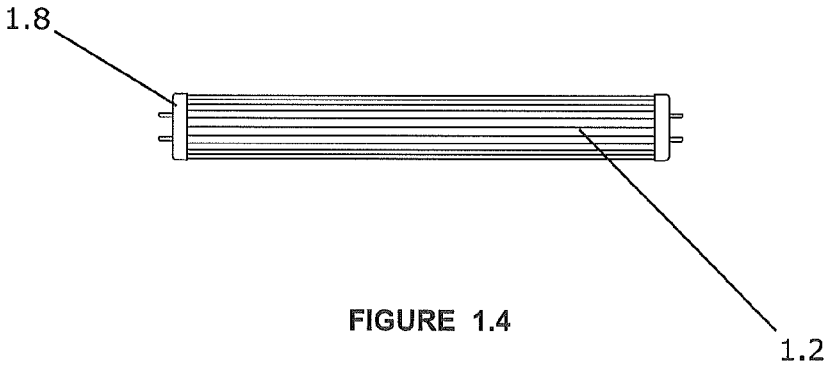
FIGURE 1.4
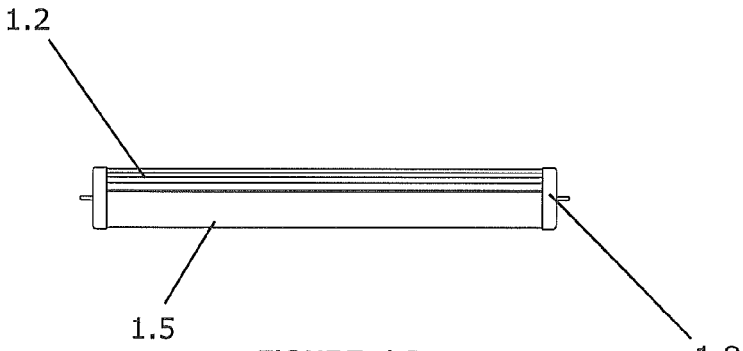
FIGURE 1.5

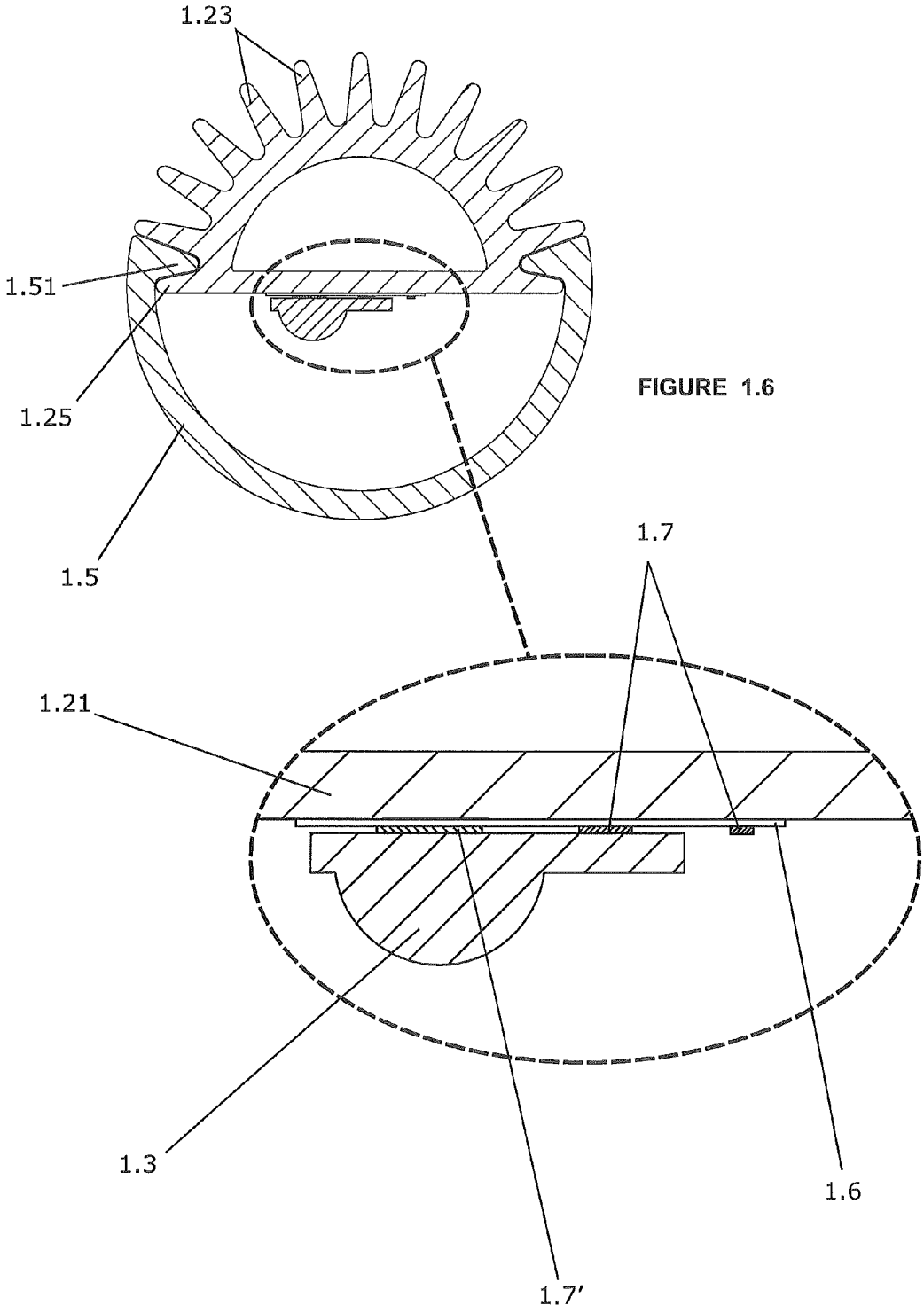
FIGURE 1.6

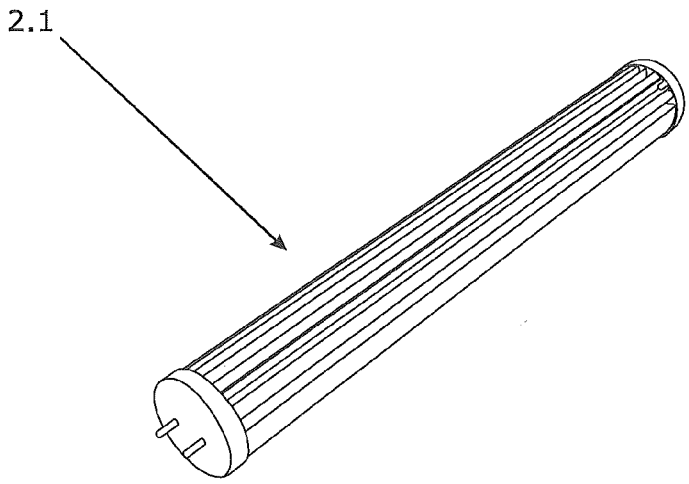
FIGURE 2.1
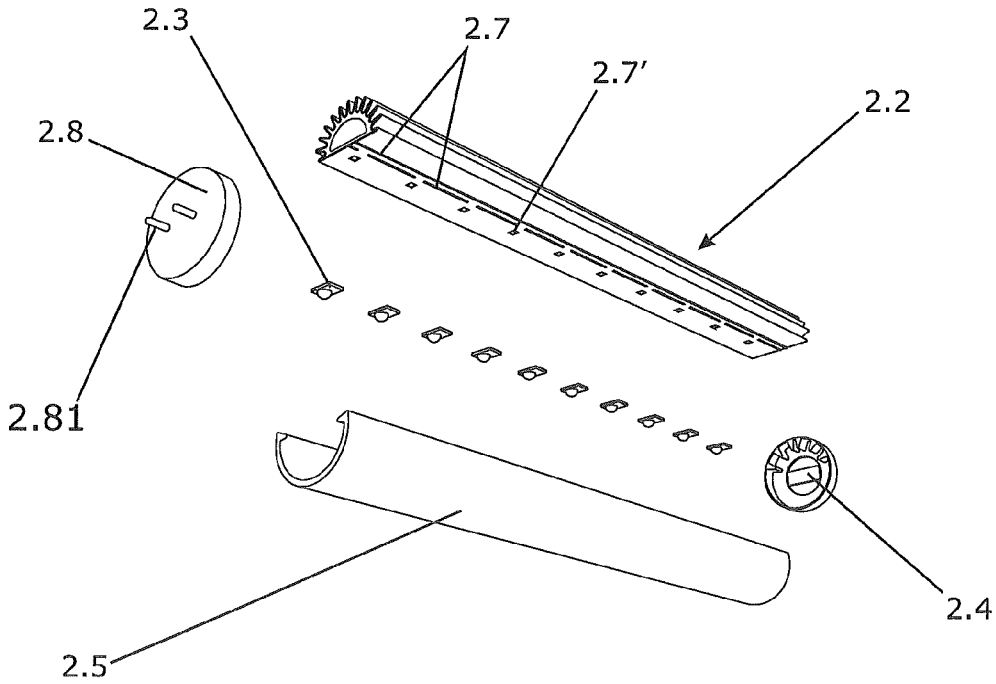
FIGURE 2.2

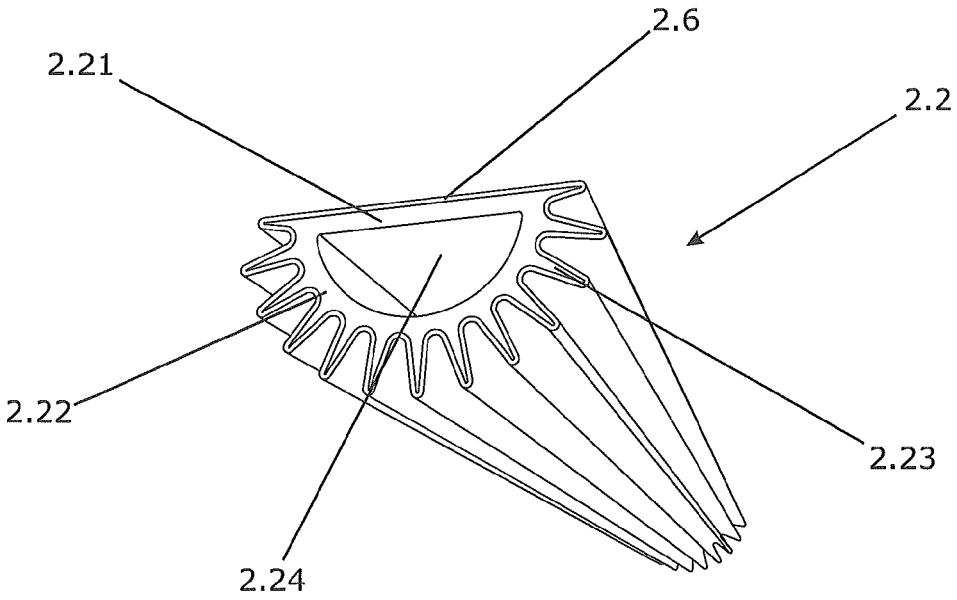
FIGURE 2.3
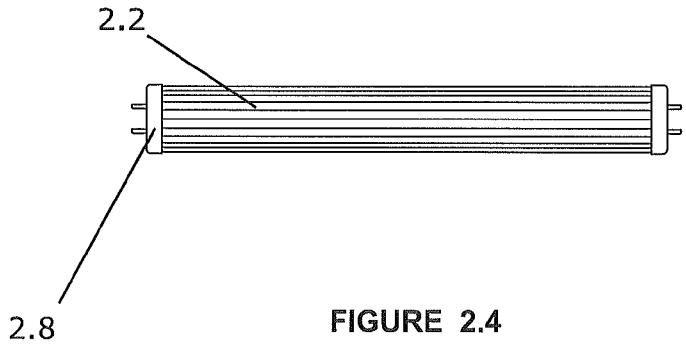
FIGURE 2.4
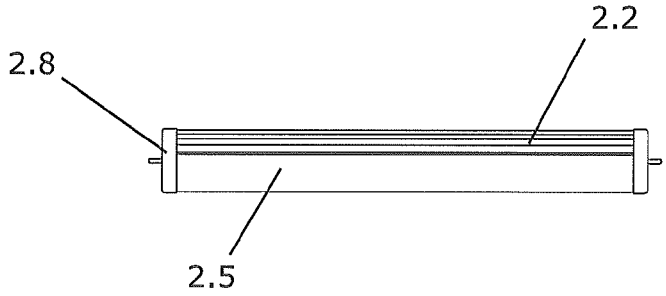
FIGURE 2.5

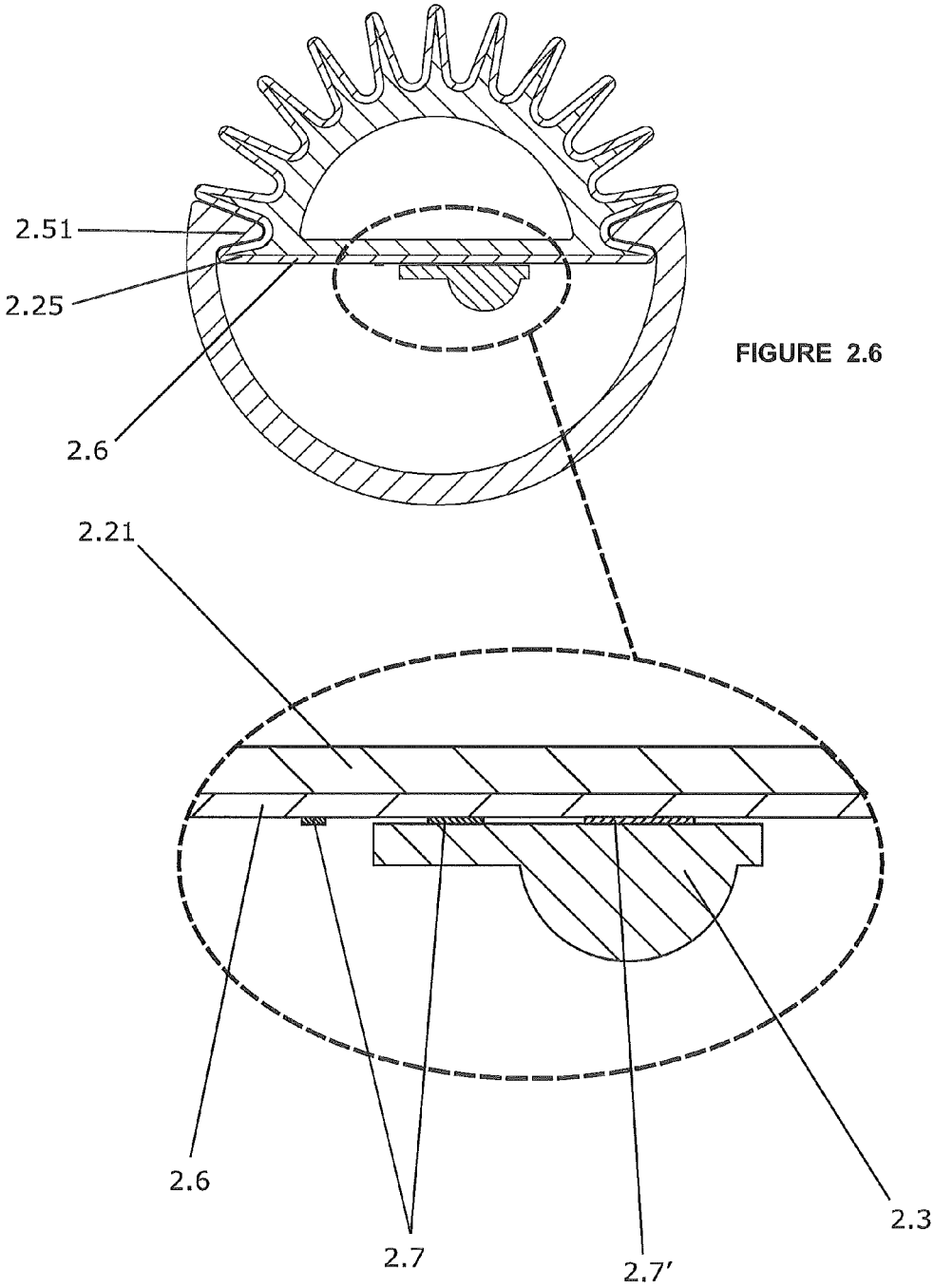
FIGURE 2.6

HIGH POWERED LIGHT EMITTING DEVICE

FIELD OF THE TECHNOLOGY

The present invention relates to light-emitting diode (LED) lighting technology. More particularly, the present invention relates to a lighting device which utilizes high power LED technology in order to produce a light source more efficient and durable than fluorescent lighting and also more practical with respect to production and installation than conventional LED lighting.

BACKGROUND

Fluorescent Tubes Generally

Fluorescent tubes were first designed and fabricated by Nikola Tesla, and presented at the Chicago World's Fair in 1893. These tubes were not made available to the consumer market however until mid-1938.

Fluorescent light is a light a light source achieved through the ionization of gases—a principle of operation known as cold plasma. A fluorescent lamp consists of a tube filled with a gas containing low pressure mercury vapor and argon (or some other ionziable gas), an electro-electronic circuit and two pairs of opposing terminals; the gas is ionized through the use of an electric current or an electromagnetic field.

Conventional fluorescent tubes have a higher efficacy than incandescent tubes, being that fluorescent tubes transform more of the electromagnetic energy into light than into heat. This is because the phosphorus deposited throughout the inner wall of the glass tube produces visible light when excited by the ultraviolet radiation generated by the ionization of the gas; there is no displacement of electrons through a solid medium such as a filament as is the case with incandescent lighting.

Fluorescent tubes are from two to four times more efficient and more economical (about 70%) than incandescent lamps (tubes). Although fluorescent tubes are superior to incandescent lamps in most respects, they are not without certain disadvantages.

Most fluorescent tubes contain toxic materials (ionizing gases, fluorescent pigments and mercury) which may be harmful to humans; therefore, a controlled and supervised disposal is required due to the risk of environmental contamination. Moreover, fluorescent tubes are typically designed to be installed in pairs. Thus, when one tube is defective and/or burned out, it is necessary to replace the both tubes, regardless of the other tube's condition.

Use of Light-Emitting Diodes for Lighting:

A light-emitting diode (LED) is an electronic component made from semiconductor materials that has the ability to generate light from electrical stimuli. Traditionally, light-emitting diodes were limited to use in electronic equipment, such as a visual signaler; this was due to the poor luminosity provided by early LED technology.

With the development of new technology and materials, it has become possible to fabricate high-power light-emitting diodes capable of providing light with an efficacy equal to or greater than that of the fluorescent tubes commonly used today. Furthermore, high-power light-emitting diodes are generally more efficient and economical than incandescent and fluorescent tubes. However, the use of said high-power light-emitting diodes in residential/industrial lighting poses a significant problem—with the extensive use of fluorescent lights, there was a significant investment in infrastructure (equipment technology) related to the installation of these tubes, after all, fluorescent tubes require adequate facilities (specific supports, specific reactors, specific connectors, among others) for their correct operation; thus, it is not economically viable to replace the entire infrastructure already existing with another type of technology.

In order to avoid this problem (not technical, but economic), adaptive designs were developed in order to allow the integration of light-emitting diodes (high-power or not) with existing infrastructure.

The current state of the art provides a multitude of adaptive designs, which LEDs are being used in fluorescent tubes. Examples of these designs are disclosed in the U.S. Pat. No. 6,583,550 and U.S. Pat. No. 7,114,830.

U.S. Pat. No. 6,583,550 filed in Oct. 23, 2001, discloses a fluorescent lamp composed of a glass tubular body internally coated with a fluorescent material. Inside of said fluorescent tube, there are light-emitting diodes (in this case, ultraviolet light). Its operating principle is similar to the one of a conventional fluorescent tube, i.e., the ultraviolet light causes the fluorescent material to produce visible light. It also discloses that the glass tubular body can be made of a ductile and translucent material, resulting in a flexible lamp with a capacity to change its shape. It must be noted that the efficacy of this lamp is still dependent on the quality and quantity of the fluorescent material used inside of the lamp and therefore becomes totally inoperative when the material is removed from the tube.

The U.S. Pat. No. 7,114,830 filed in Feb. 28, 2005, discloses a lamp consisting of a rigid transparent tube, a plurality of light-emitting diodes arranged within the tube, and a reflective coating disposed circumferentially about a portion of said tube. The emission of light from said light-emitting diodes is directed to the reflective coating of the tube. Although this lamp does not present the multitude of problems associated with traditional fluorescent tubes, its luminous efficacy is lacking because it does not support the use of high-power LEDs; being that this lamp is lacking an efficient means of heat dissipation, it must rely solely on conventional low-power LEDs The lamps described in U.S. Pat. No. 6,583,550 and U.S. Pat. No. 7,114,830 are mere examples of the same concept. They disclose the adaptation of light-emitting diodes to conventional fluorescent tubes, allowing the lamps to be used with existing infrastructure (related to conventional fluorescent tubes). In these examples, as in many others, high-power light-emitting diodes are not used, which could increase the efficacy of the lamps.

High-power LEDs are also being used in certain lamps; in particular, lamps specially designed for integration with the conventional fluorescent tube infrastructure.

U.S. Patent Publication No. 2009-0261706 published on Oct. 22, 2009, discloses such a lamp. Said lamp comprises a plurality of high-power light-emitting diodes mounted to a printed circuit board, a heat sink and a translucent lens. The light-emitting diodes are mounted on the circuit board, by means of tin-lead solders, and the heat sink is fixed to this printed circuit board by means of heat paste. The heat sink is composed of an aluminum finned plate with a semi-circular profile.

On one hand, this design allows the fins to be in contact with the external environment, but on the other hand, it prevents an efficient heat exchange between the light-emitting diodes and the heat sink, respectively.

In addition, this lamp has an unnecessarily large inner dead space, which may have a detrimental effect on its heat dissipation and ultimately its efficacy. This problem is becoming more apparent as high-power light-emitting diode technology progresses. Since technological improvements have resulted in the creation of more powerful light-emitting diodes, LED lighting technology has become more dependent on efficient means of heat dissipation.

The present invention was developed based on the aforementioned concepts.

SUMMARY

The present invention provides an apparatus designed to address the aforementioned problems with existing LED lighting technology. This is achieved through implementation of an efficient mean of heat dissipation The apparatus comprises a plurality of LED's fixed to a heat dissipation based and covered by a translucent material, that could be opaque and of several colors. The present invention is free from an electronic circuit board and does not require the use of heat dissipation paste.

The first embodiment of said electronic lighting device utilizes a thin dielectric resin layer which is disposed between the surface of the heat sink and the LEDs.

The second embodiment of said electronic lighting device utilizes an electrical insulation layer which is disposed between the surface of the heat sink and the LEDs.

Being that said LEDs are fixed directly to said heat sink, without the need for a printed circuit board or for the use of heat dissipation paste, heat exchange between the LEDs and the external environment becomes more efficient.

Said heat sink that integrates the electronic lighting device disclosed herein has a structural and physical construction that allows efficient heat exchange between said high-power light-emitting diodes and the external environment.

BRIEF DESCRIPTION OF THE FIGURES

The present invention will be now described in detail based on the figures listed below, in which:

FIG. 1.1 depicts a perspective view of an embodiment of an electronic lighting device;

FIG. 1.2 depicts an exploded view of an embodiment of an electronic lighting device;

FIG. 1.3 depicts a perspective view of an embodiment of a heat sink;

FIG. 1.4 depicts a top view of an embodiment of an electronic lighting device;

FIG. 1.5 depicts a side view of an embodiment of an electronic lighting device;

FIG. 1.6 depicts a cross-sectional end view of an embodiment of an electronic lighting device and a blow up of a cross-sectional end view of the electronic lighting device;

FIG. 2.1 depicts a perspective view of another embodiment of an electronic lighting device;

FIG. 2.2 depicts an exploded view of another embodiment of an electronic lighting device;

FIG. 2.3 depicts a perspective view of another embodiment of a heat sink;

FIG. 2.4 depicts a top view of another embodiment of an electronic lighting device;

FIG. 2.5 depicts a side view of another embodiment of an electronic lighting device;

FIG. 2.6 depicts a cross-sectional end view of an embodiment of an electronic lighting device and a blow up cross-sectional end view of electronic lighting device.

DESCRIPTION

The first embodiment includes a mounting base for an electrical circuit, which is disposed on the surface of the heat sink used as a structural base. This mounting base for electrical circuit is basically formed by a dielectric layer formed by applying and drying of dielectric resin, and a conductive layer formed by applying conductive adhesive, conductive paste or conductive ink.

As depicted in FIGS. 1.1, 1.2, 1.3, 1.4, 1.5 and 1.6, the first embodiment of the electronic lighting device (1.1), is comprised of a heat sink (1.2), a plurality of light-emitting diodes (1.3), and at least one electronic circuit (1.4). Optionally, it may also be composed of a translucent lens (1.5) and a pair of side covers (1.8).

With reference to the drawings, FIG. 1.1 depicts a perspective view of an embodiment of an electronic lighting device (1.1). FIG. 1.2 depicts an exploded view of the same embodiment. The electronic lighting device is comprised of a heat sink (1.2), is a monoblock body made of metal alloy; preferably aluminum. Said heat sink (1.2) is composed of one flat wall (1.21) and one semi-circular wall (1.22). Said flat wall (1.21) is disposed between the ends of the semi-circular wall (1.22). Said semi-circular wall (1.22) has multiple fins (1.23) arranged radially on its outer face.

Said heat sink (1.2) has a space (1.24) between said flat wall (1.21) and said semi-circular walls (1.22). It is also worth mentioning that said heat sink (1.2) has two longitudinal channels (1.25), wherein each said longitudinal channel is positioned next to one of the ends of said semi-circular wall (1.22). Optionally, the inner face of the space 1.24 has radially arranged fins.

Said light-emitting diodes (1.3) are preferably high-power light-emitting diodes, which have two or more electrical terminals and a support base.

The outer surface of said flat wall (1.21) of said heat sink (1.2) is coated with a dielectric layer (1.6) onto which a metal track (1.7) and a plurality of metal islands (1.7') are fixed.

Said dielectric layer (1.6) is preferably composed of a resin (pasty in its natural physical state, but becomes solid after drying) made of epoxy with curing agents (from about 10% to 60% by weight) and heat conductive micro particles (from about 40% to 90% by weight). Preferably, said curing agents include methyl tetrahydro phthalic anhydride; nadic methyl anhydride, dicyandiamide, diethyl toluene diamine and other conventional and known curing agents. Preferably, said heat conductive micro particles include alumina, boron nitride, silicon carbide, zinc oxide and the family of refractory oxides in general.

Said resin may be selectively applied to the surface of said flat wall (1.21) of said heat sink (1.2) by conventional methods of graphic printing.

Said dielectric layer (1.6) has two main functions. The first function is that the layer electrically isolates the light-emitting diodes (1.3) from the heat sink (1.2). The second function is that the layer conducts the heat generated by light-emitting diodes (1.3) into to the heat sink (1.2), wherein said heat sink (1.2) exchanges this heat with the external environment.

Said metal tracks (1.7) are arranged on the dielectric layer (1.6) in electrical-functional layout; this layout allows the light-emitting diodes (1.3) to become interconnected, forming an electronic circuit (1.4). Said metal tracks (1.7) are preferably composed of conductive adhesive, conductive ink or conductive paste, such as silver paste or copper powder ink. Said conductive ink or conductive paste can be applied by conventional methods of graphic printing. Optionally, said metal tracks (1.7) can be composed of an electrically conductive adhesive.

Said metal islands (1.7') are arranged on the dielectric layer (1.6), isolated from the metal tracks (1.7). Said metal islands (1.7') are most often composed of conductive ink or conductive paste, such as silver paste or copper powder ink. Said conductive ink or conductive paste can be applied by conventional methods of graphic printing. Optionally, said metal islands (1.7') can be composed of electrically conductive adhesive.

Due to their spacing, said metal islands (1.7') define the positioning of said light-emitting diodes (1.3).

Said electronic circuit (1.4) has the function of adjusting the electrical signal (voltage/electric current) from the infrastructure (reactors in general). Said electronic circuit (1.4) is preferably interconnected with said light-emitting diodes (1.3) through said metal track (1.7).

Said translucent lens (1.5) comprises a semi-circular monoblock body made of translucent material, preferably a transparent polymer alloy. Said lens (1.5) has two fitting ends (1.51) which slide into the longitudinal channels (1.25) of said heat sink (1.2).

The profile formed by the junction of said heat sink (1.2) and said translucent lens (1.5) is circular, i.e., the dimensions of said lens (1.5) are complementary to the dimensions of said heat sink (1.2).

Said side covers (1.8) have a circular profile with a dimension compatible to the circumferential dimension formed by the junction of said heat sink (1.2) and lens (1.5). Moreover, said side covers (1.8) are disposed on the side ends of the device (1.1). A pair of metal pins (1.81) protrude from the outer face of each side cover (1.8), wherein said pair of metal pins (1.81) have an electrical connection with said electronic circuit (1.4) and said light-emitting diodes (1.3).

Said light-emitting diodes (1.3) are arranged on the dielectric layer (1.6) and electrically connected through metal tracks (1.7). Also, said light-emitting diodes (1.3) are fixed to their respective metal island (1.7').

Said electrical terminals of said light-emitting diodes (1.3) are electrically connected to the metal tracks (1.7), preferably, by means of electronic soldering or by a conductive adhesive.

The support base of each light-emitting diode (1.3) is soldered to its respective metal island (1.7'). Optionally, said support base of each light-emitting diode (1.3) may be glued to their respective metal island (1.7') by means of high thermal conductivity adhesive paste.

As mentioned previously, said "second embodiment" generally refers to the non existence of any type of printed circuit board or even the existence of any type of any mounting base for an electrical circuit on the surface of the heat sink used as a structural base. In this situation, said printed circuit board is replaced by a conductive layer formed by applying conductive ink or conductive paste (where light-emitting diodes will be mounted) and the heat sink is anodized. Unlike the "first embodiment" described above, in said "second embodiment", it is not used any kind of dielectric resin between the surface of said heat sink and said conductive layer, due to the existence of an insulating layer (oxide layer created in the anodizing process or similar), wherein said layer is disposed in a intrinsic and surround way on all faces of said heat sink.

As depicted in FIGS. 2.1, 2.2, 2.3, 2.4, 2.5 and 2.6, as the second embodiment of the device (2.1)) is fundamentally composed of a heat sink (2.2), a plurality of light-emitting diodes (2.3), and at least one electronic circuit (2.4). Optionally, it is also composed of a translucent lens (2.5) and side covers (2.8).

Said heat sink (2.2), is comprised of a mono-block body made of a metal alloy, preferably aluminum.

Said heat sink (2.2) is composed of one flat wall (2.21) and one semi-circular wall (2.22). Said flat wall (2.21) is disposed between the ends of the semi-circular wall (2.22). Said semi-circular wall (2.22) has multiple fins arranged radially (2.23) on its outer face. Said heat sink (2.2) has a space (2.24) between said flat wall (2.21) and said semi-circular wall (2.22). It is also has two longitudinal channels (1.25), wherein each said longitudinal channel is positioned next to one of the ends of said semi-circular wall (1.22).(2.25), wherein each said longitudinal channel is positioned next to one of the ends of said semi-circular wall (2.22). Optionally, the inner face of said space (2.24) also has radially arranged multiple fins.

It is also noted that said heat sink (2.2) is structural, i.e., includes the entire mounting base of the device (2.1). Said light-emitting diodes (2.3) are preferably high-power light-emitting diodes, which have, preferably, two electrical terminals and a support base consisted of a metal base designed to the fixation and the heat dissipation.

The outer surface of said flat wall (1.21) of said heat sink (1.2) is coated with an oxide layer, preferably shaped by a conventional anodizing process or the like, (1.6) onto which a metal track (1.7) and a plurality of metal islands (1.7') are fixed.

Said oxide layer (2.6) has electrical insulation properties, and is therefore, functionally similar to any insulating material, but with the advantage of being irremovable. Said oxide layer (2.6), due to its natural porosity, enables the adhesion of inks and the like, allowing the simultaneous forming of an aesthetic finish to the heat sink (2.2) when said oxide layer (2.6) is shaped.

Said oxide layer (2.6) has two main functions. The first function is that the layer electrically isolates the light-emitting diodes (2.3) from the heat sink (2.2). The second function is that the layer conducts the heat generated by light-emitting diodes (2.3) into to the heat sink (2.2), wherein said heat sink (2.2) exchanges this heat with the external environment.

Said metal tracks (2.7) are arranged on the oxide layer (2.6) in electrical-functional layout; this layout allows the light-emitting diodes (2.3) to become interconnected, forming an electronic circuit (2.4). Said metal tracks (2.7) are preferably composed of conductive adhesive, conductive ink or conductive paste, such as silver paste or copper powder ink. Preferably, said conductive ink or conductive paste can be applied by conventional methods of graphic printing. Optionally, said metal tracks (2.7) can be composed of an electrically conductive adhesive.

Said metal islands (2.7') are arranged on the oxide layer (2.6), isolated from said metal tracks (1.7). Said metal islands (2.7') are preferably composed of conductive adhesive, conductive ink or conductive paste, such as silver paste or copper powder ink. Preferably, said conductive ink or conductive paste can be applied by conventional methods of graphic printing. Optionally, said metal islands (2.7') can be composed of an electrically conductive adhesive. Based on spacing, the metal islands (2.7') define the positioning of the light emitting diodes (2.3).

Said electronic circuit (2.4) has the function of adjusting the electrical signal (voltage/electric current) from the infrastructure (reactors in general) related to conventional fluorescent tubes to functional parameters related to a perfect operation of light-emitting diodes (2.3). Said electronic circuit (2.4) is preferably interconnected with said light-emitting diodes (2.3) through said metal track (2.7).

Said translucent lens (2.5) comprises a semi-circular monoblock body made of translucent material, preferably a transparent polymer alloy. Said lens (2.5) has two fitting ends (2.51) which slide into the longitudinal channels (2.25) of said heat sink (2.2).

The profile formed by the junction of said heat sink (2.2) and said translucent lens (2.5) is circular, i.e., the dimensions of said lens (2.5) are complementary to the dimensions of said heat sink (2.2).

Said side covers (2.8) have circular profile with a dimension compatible to the circumferential dimension formed by the junction of said heat sink (2.2) and said translucent lens (2.5). Moreover, said side covers (2.8) are disposed on the side ends of the device (2.1). A pair of metal pins (2.81) protrudes from the outer face of each side cover (2.8), wherein said pair of metal pins (2.81) has an electrical connection with said electronic circuit (2.4) and said light-emitting diodes (2.3).

Said light-emitting diodes (2.3) are arranged on the oxide layer (2.6) and electrically connected through metal tracks (2.7). Also, said light-emitting diodes (2.3) are fixed to their respective metal island (2.7').

Said electrical terminals of said light-emitting diodes (2.3) are electrically connected to the metal tracks (2.7), preferably by means of electronic soldering or by a conductive adhesive. The support base of each light-emitting diode (2.3) is soldered on their respective island metal (2.7'). Optionally, said support base of each light-emitting diode (2.3) may be glued to their respective metal island (2.7') by means of high thermal conductivity adhesive paste.

The invention claimed is:

1. A high-power light emitting device comprising:

a thermal dissipation base having a heat sink with a dielectric layer onto which a metal track and a plurality of metal islands are fixed;

a plurality of light-emitting diodes having electrical terminals, each one fixed to at least one of said plurality of metal islands and electrically connected through said metal track forming an electronic circuit;

a translucent lens attached to said thermal dissipation base;

a pair of circular side covers having metal pins on their outer faces wherein both of the pair of circular side covers have a circumferential dimension allowing said pair of circular side covers to fit over a circular profile formed by a junction of said heat sink and said translucent lens.

2. The device of claim 1 wherein said heat sink is composed of at least one flat wall and at least one semi-circular wall.

3. The device of claim 2 wherein said flat wall is disposed between two ends of said semi-circular wall, wherein said semi-circular wall has multiple fins arranged radially on an outer face of the semi-circular wall.

4. The device of claim 3 wherein said heat sink has a space between at least one said flat wall and at least one said semi-circular wall and said heat sink has two longitudinal channels, wherein each said longitudinal channel is positioned adjacent to one of each of the ends of said semi-circular wall.

5. The device of claim 4 wherein said heat sink is composed of a metal alloy.

6. The device of claim 5 wherein said metal alloy is composed of aluminum.

7. The device of claim 2 wherein said dielectric layer is disposed on a surface of said flat wall of said heat sink.

8. The device of claim 1 wherein said dielectric layer is composed of a resin made of epoxy with curing agents and heat conductive micro particles, wherein said epoxy with curing agents comprises from about 10% to 60% by weight of said resin and said heat conductive micro particles comprises from about 40% to 90% by weight of said resin.

9. The device of claim 8 wherein said curing agents include methyl tetrahydro phthalic anhydride, nadic methyl anhydride, dicyandiamide, diethyl toluene diamine, and the like.

10. The device of claim 8 wherein said heat conductive micro particles include alumina, boron nitride, silicon carbide, zinc oxide and the family of refractory oxides.

11. The device of claim 1 wherein said metal track are arranged on the dielectric layer in an electrical-functional layout, and said metal track being composed of conductive ink or conductive paste.

12. The device of claim 1 wherein said metal track is composed of an electrically conductive adhesive.

13. The device of claim 1 wherein said plurality of metal islands are isolated from said metal track and said plurality of metal islands are composed of conductive ink or conductive paste.

14. The device of claim 1 wherein said plurality of metal islands are composed of an electrically conductive adhesive.

15. The device of claim 1 wherein the light-emitting diodes are soldered to their respective metal island and the electrical terminals of said light-emitting diodes are electrically connected to said metal track.

16. The device of claim 13 wherein said electrical terminals of said light-emitting diodes are electrically connected to said metal track by means of electronic soldering or a conductive adhesive.

17. The device of claim 13 wherein said light-emitting diodes are glued to their respective metal island by means of a high electrical conductivity adhesive.

18. The device of claim 13, wherein the electrical interconnection of said light-emitting diodes and said electronic circuit is extended to the metal pins of said covers.

19. A high-power LED lighting device comprising:

a thermal dissipation base comprising a heat sink having an oxide layer onto which a metal track and a plurality of metal islands are fixed;

a plurality of light-emitting diodes having electrical terminals, each one fixed to one of said plurality of metal islands and electrically connected through said metal track forming an electronic circuit;

a translucent lens attached to said thermal dissipation base;

a pair of circular side covers having metal pins on their outer faces wherein both of the pair of circular side covers have a circumferential dimension allowing said pair of circular side covers to fit over a circular profile formed by a junction of said heat sink and said translucent cover.

20. The device of claim 19, wherein said heat sink is composed of at least one flat wall and at least one semi-circular wall.

21. The device of claim 20, wherein said at least one flat wall is disposed between the two ends of said semi-circular wall, and said at least one semi-circular wall has multiple fins arranged radially on an outer face of the semi-circular wall.

22. The device of claim 21, wherein said heat sink has a space between said at least one flat wall and said at least one semi-circular wall and has two longitudinal channels, wherein each said longitudinal channel is positioned adjacent to one of each of the ends of said semi-circular wall.

23. The device of claim 22 wherein said heat sink is composed of a metal alloy.

24. The device of claim 23, wherein said metal alloy is aluminum.

25. The device of claim 20, wherein said metal track and said plurality of metal islands are provided on the oxide layer existing on a surface of the at least one flat wall of said heat sink.

26. The device of claim 19, wherein the adhesion of inks and the like are enabled.

27. The device of claim 19, wherein said metal track are composed of an electrically conductive adhesive.

28. The device of claim 19 wherein said metal track are arranged on the oxide layer in electrical-functional layout, and said metal track being composed of conductive ink or conductive paste.

29. The device of claim 19, wherein said plurality of metal islands are isolated from said metal track, and said plurality of metal islands are composed of conductive ink or conductive paste.

30. The device of claim 19 wherein said plurality of metal islands are composed of an electrically conductive adhesive.

31. The device of claim 19 wherein said electrical terminals of said light-emitting diodes are electrically connected to the metal tracks and each light-emitting diode is soldered to its respective metal island.

32. The device of claim 31 wherein said electrical terminals of said light-emitting diodes are electrically connected to said metal track by means of electronic soldering or a conductive adhesive.

33. The device of claim 31, wherein said light-emitting diodes are glued to their respective island metal by means of high electrical conductivity adhesive pastes.

34. The device of claim 31, wherein said electrical interconnection of said light-emitting diodes and said electronic circuit is extended to the metal pins of said covers.

* * * * *